US005787513A

United States Patent [19]

Sharmat et al.

[11] Patent Number: 5,787,513

[45] Date of Patent: Aug. 4, 1998

[54] SAFETY HELMET HAVING MEANS FOR EASY REMOVAL FROM THE HEAD OF A WEARER

[76] Inventors: Samuel L. Sharmat; Darren M. Clevenger, both of 318 W. 90th St., New York, N.Y. 10024

[21] Appl. No.: 752,067

[22] Filed: Nov. 19, 1996

[51] Int. Cl.[6] ..... A42B 3/00

[52] U.S. Cl. ..... 2/411; 2/424

[58] Field of Search ..... 2/410, 411, 421, 2/422, 424, 425, 6.1, 6.2, 6.3, 6.4

[56] References Cited

U.S. PATENT DOCUMENTS

| | | | |
|---|---|---|---|
| 2,861,272 | 11/1958 | Stuart et al. | 2/410 |
| 3,943,571 | 3/1976 | Boatman | 2/421 |
| 3,987,495 | 10/1976 | Holley | 2/410 |
| 4,291,418 | 9/1981 | Zeisler | 2/410 |
| 4,477,929 | 10/1984 | Mattsson | 2/425 |
| 4,734,940 | 4/1988 | Galet et al. | 2/422 |
| 4,918,752 | 4/1990 | Briggs | 2/6.2 |
| 5,475,878 | 12/1995 | Dawn et al. | 2/411 |
| 5,584,073 | 12/1996 | Radzelovage et al. | 2/6.3 |

*Primary Examiner*—Michael A. Neas
*Attorney, Agent, or Firm*—Howard C. Miskin

[57] ABSTRACT

A helmet that provides protection to the head and neck regions of a wearer is disclosed and is comprised of separable front and rear portions so as to allow easy removal from the head of the wearer. The easy removal of the helmet prevents further agitation to any head and/or neck injuries always created by the wearer suffering from a sudden impact.

6 Claims, 3 Drawing Sheets

SAFETY HELMET HAVING MEANS FOR EASY REMOVAL FROM THE HEAD OF A WEARER

BACKGROUND OF THE INVENTION

1. Field of the Invention

The present invention relates to a helmet and, more particularly, to a helmet for protecting the head of a wearer from injury caused by a sudden impact, yet allowing for the easy removal from the wearer that may have encountered a head and/or neck injury and do so without agitating the head and/or neck region of the wearer and, thus, not further agitating any head and/or neck injury of the wearer.

2. Description of Related Art

Helmets used while riding a motorcycle or participating in vigorous sports which may allow for the possibility of head injuries, such as hockey, football, skiing, are well known, are comprised of a hard material resistant to impact, and provide a protective covering for the head of the wearer. Further, helmets are typically contoured to reduce aerodynamic drag, while at the same time contoured and padded so as to conform to the head of a human so as to reduce the effects of any sudden impacts that might otherwise cause head and/or neck injuries. Helmets serve well their intended purpose and have made a dramatic impact over the years in reducing head injuries, as well as neck injuries, that might otherwise occur from a sudden impact. However, helmets, especially contoured and padded helmets, have also hindered effective patient management from roadside to the emergency room. More particularly, because of the closely conforming helmet, a person wearing a helmet may be subjected to agitation of head and/or neck injuries when a trained paramedic at the roadside or site of the injury, or a trained medical professional at the emergency room, removes the conforming helmet to provide trauma management of the injuries. It is desired that a helmet be provided that not only protects a wearer against injuries caused by sudden impacts, but also a helmet that is easily removed from an injured person without further agitating any possible head and/or neck injuries.

OBJECTS OF THE INVENTION

Accordingly, it is an object of the present invention to provide a helmet that is padded and/or contoured so as to substantially conform to the dimensions of a head of a human, yet has means so that the helmet can be easily removed from the head of a wearer without substantially disturbing the head and/or neck regions of the wearer.

It is a further object of the present invention to provide a helmet having separable front and rear portions that are brought together in such a manner as to have complementary mating therebetween.

It is a further object of the present invention to provide a helmet with a vertical axis and having means so as to bring together the separable front and rear portions longitudinally along the vertical axis or coronal plane that separates the front of the helmet from the rear of the helmet.

It is still a further object of the present invention to provide a helmet having clamp means for pressing and holding together separable front and rear portions.

SUMMARY OF THE INVENTION

The present invention is directed to a helmet that snugly fits about the head of a human and has means for being removed without substantially disturbing the head and/or neck regions of the wearer.

The helmet comprises a material resistant to impact and provides protective covering for the head of a wearer. The helmet has a vertical axis, comprises front and rear separable portions, and has means for mating and bringing together the separable front and rear portions. The front portion has a face opening therein and each of the front and rear separable portions are contoured so as to generally conform to the typical dimensions of the head of a wearer.

DETAILED DESCRIPTION OF THE PREFERRED EMBODIMENTS

Figure 1:
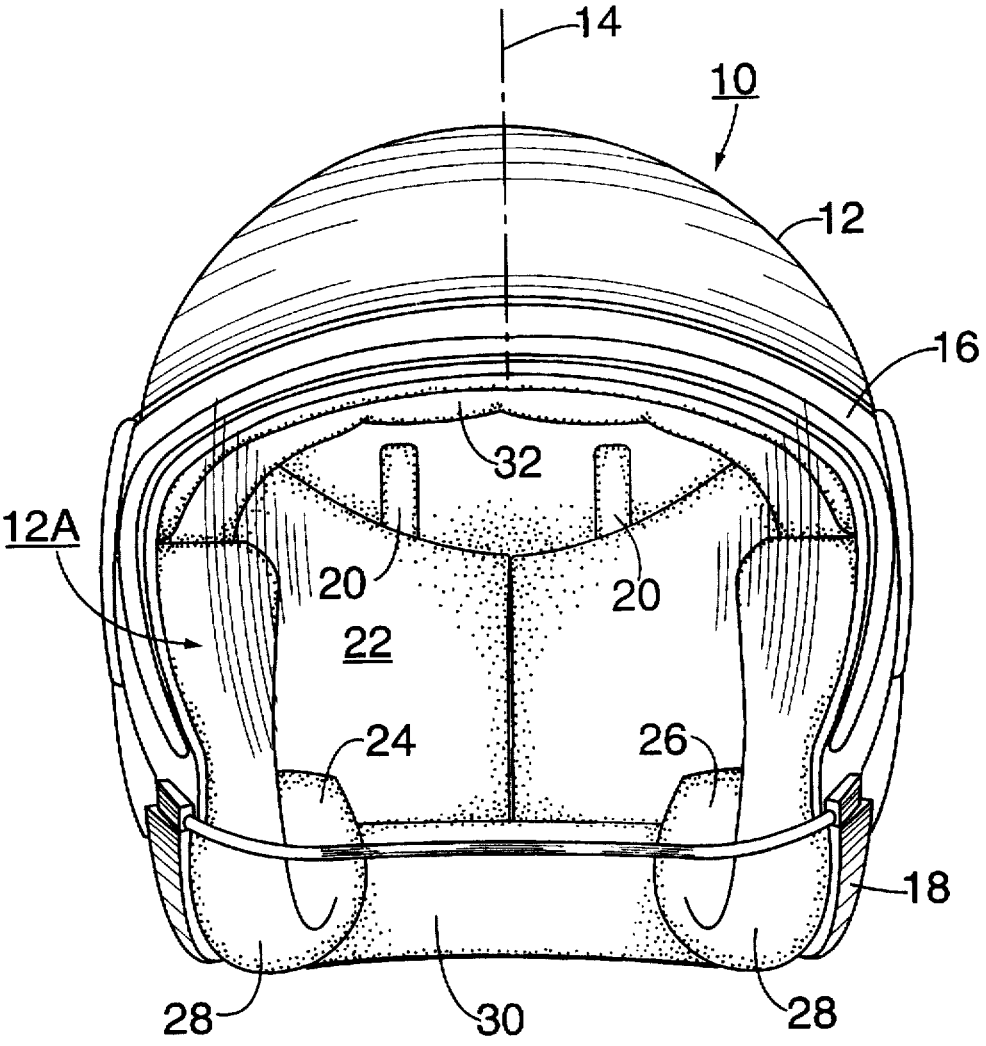
FIG. 1 is a front view of a helmet according to one embodiment of the present invention.

Referring to the drawings, wherein the same reference numbers indicate the same elements throughout, there is shown in FIG. 1 a front view of a helmet 10 of the present invention. The helmet 10 has some of the features of the helmet disclosed in U.S. Pat. No. 5,088,129 ('129), issued Feb. 18, 1992, and herein incorporated by reference. The helmet 10 may be used while riding a motorcycle, playing hockey or participating in vigorous sports which may allow for the possibility of head injuries, such as hockey, football and skiing and for all uses, provides a protective covering for the head of the wearer to safeguard, in a manner known in the art, against head and/or neck injuries caused by sudden impacts.

The helmet 10 comprises a shell 12 typically made of hard high strength resin, known in the art, and has a face portion 12A, as well as a vertical axis 14. Further, the helmet 10 preferably further comprises a shield plate 16 made of a transparent synthetic resin and has a lower portion positionable near an edge member 18 which is adhesively fitted to the lower edge of the shell 12. The shield plate 16 may be pivotally connected to the shell 12, in a manner known in the art, and also as more fully disclosed in the '129 patent. The '129 patent also discloses ventilation grooves, such as the grooves 20 shown in FIG. 1.

The helmet 10 preferably further comprises a buffer liner 22 made of foamed styrol which is closely fitted to the inner surface of the shell 12. The buffer liner 22 serves as impact padding means to retard the effects that might otherwise cause head and/or neck injuries when the wearer of the helmet 10 encounters sudden impacts. The buffer liner 22 further comprises ear pads 24 and 26 for receiving the wearer's ears. The ear pads 24 and 26 are preferably formed in a C-shape to provide recesses for receiving the wearer's ears and may include relatively large stitches 28.

The buffer liner 22 further preferably comprises a side pad 30 that is fundamentally formed in a looped shape so as to be brought into contact with the side portions of the wearer's head as the wearer places the helmet on his/her head. The buffer liner 22 still further comprises a ceiling pad 32 formed so as to be brought into contact with the top portion of the wearer's head as the wearer places the helmet on his/her head.

The shell 12 of helmet 10 is contoured so as to generally conform to typical dimensions of a human head, and preferably, the helmet 10 includes the impact padding 22 so as to further conform the helmet 10 to the typical dimensions of the head of a human. The helmet 10 serves well its intended purpose of providing a protective covering for the wearer's head so as to safeguard against head and/or neck injuries that may be caused by a sudden impact, but as discussed in the "Background" section may, because of its contoured features, further agitate head and neck injuries during its removal from the wearer at a roadside, site of the injury, or at an emergency room. The present invention substantially prevents such further agitation of head and/or neck injuries during the removal of the helmet 10 and may be further described with reference to FIG. 2.

Figure 2:
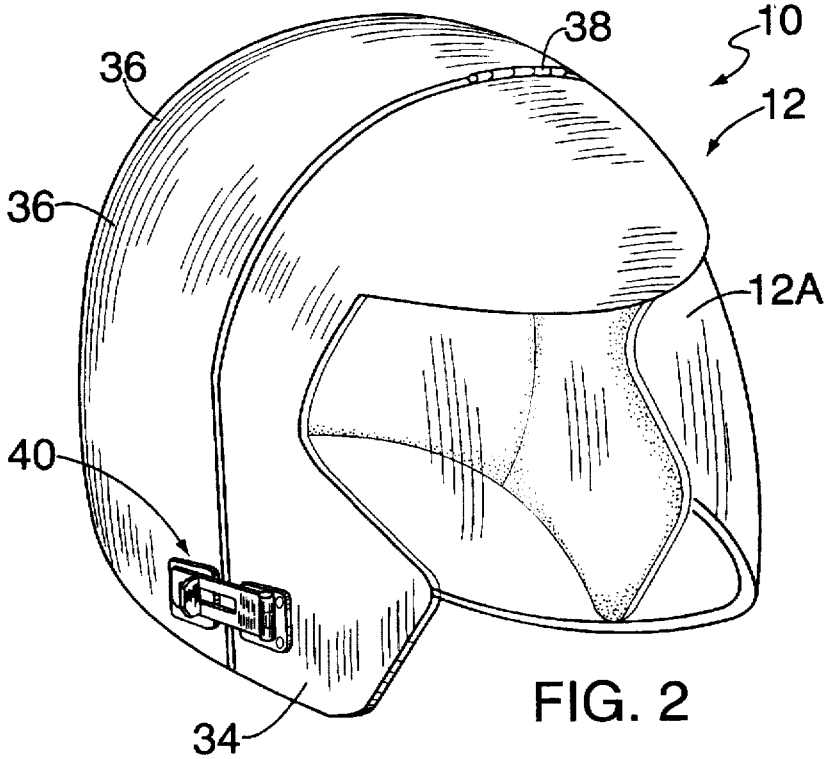
FIG. 2 is a perspective view of the helmet of FIG. 1.
Figure 3:
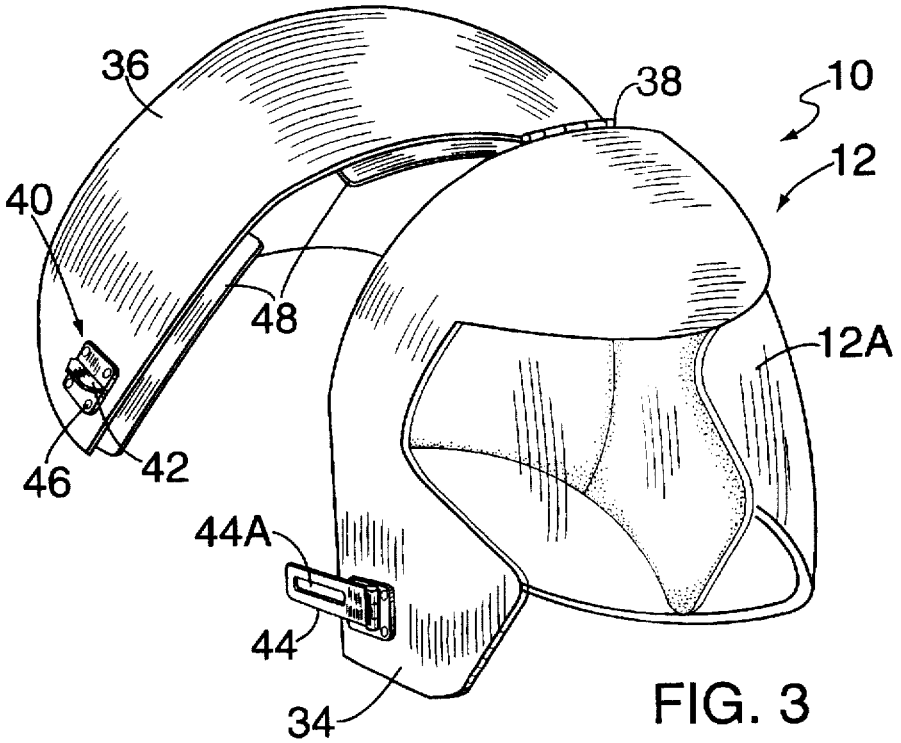
FIG. 3 is a perspective view illustrating one embodiment of the mating means of the present invention of the helmet of FIG. 1.
Figure 4:
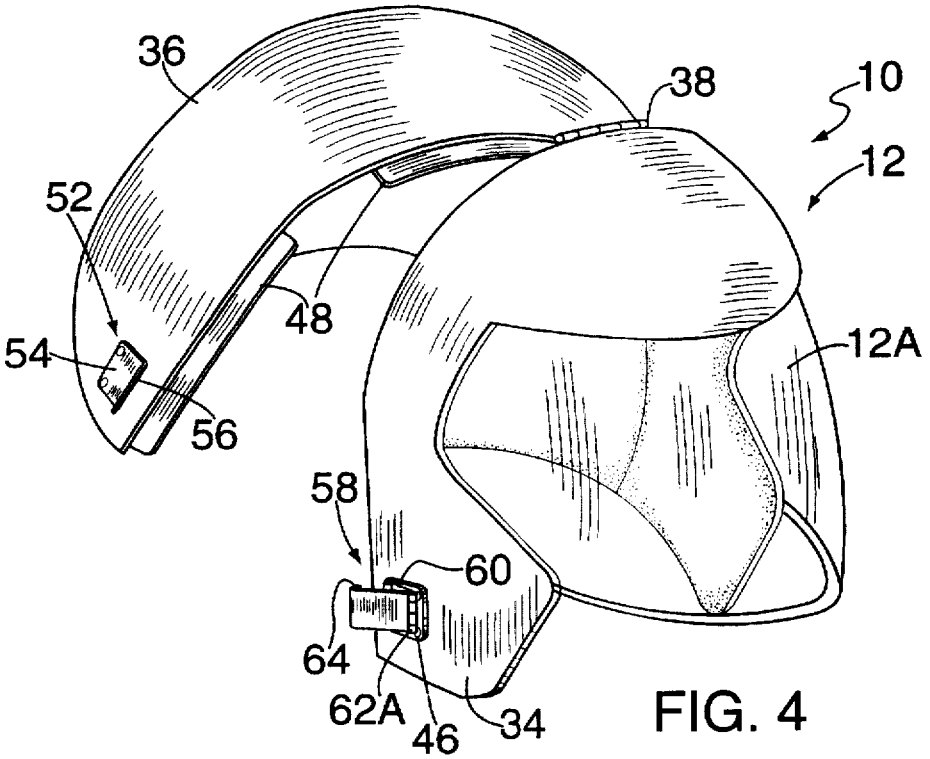
FIG. 4 is a perspective view illustrating a second embodiment of the mating means of the helmet of FIG. 1.
Figure 5:
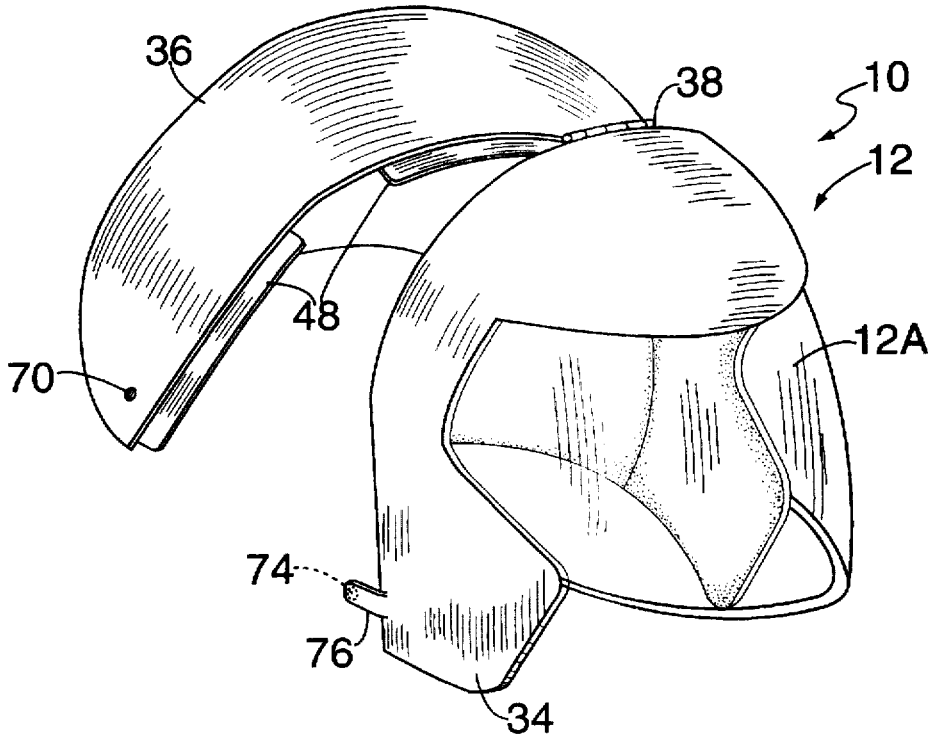
FIG. 5 is a perspective view illustrating a still further embodiment of the mating means of the helmet of FIG. 1.

FIG. 2, as well as FIGS. 3, 4 and 5 to be described, illustrates the helmet 10 as having front 34 and rear 36 separable portions, with the front portion 34 carrying the open face 12A. FIGS. 2–5 illustrate the helmet 10 with its buffer liner 22 removed. It should be recognized that the buffer liner 22, although not shown in FIGS. 2–5, is split so as to allow for the separation of the front and rear portions 34 and 36 respectively. Each of the front and rear portions 34 and 36, respectively, are shaped and generally contoured so as to conform to the dimensions of the head of the human. The helmet 10 of FIG. 2 comprises means for mating and bringing together the separable front and rear portions 34 and 36, respectively, and such means comprises a hinge means 38 and a clamp means 40 both of which are more clearly shown in FIG. 3, which is an exploded perspective view of the helmet 10 of FIGS. 1 and 2.

FIG. 3 illustrates the hinge means 38 as preferably located at the uppermost portion of the upper region of both the front and rear portions 34 and 36, respectively, and having first and second members (not shown but known in the art), respectively connected to the front and rear portions 34 and 36 by appropriate fasteners, also known in the art. The hinge means 38 is affixed and located so as to preferably and hingedly bring together the front and rear portions 34 and 36 longitudinally along the vertical axis 14 (see FIG. 1). The vertical axis 14 serves as the coronal plane that separates the front 34 of the helmet 10 from the rear 36 of the helmet 10.

The clamp means 40 presses and holds together the separable front and rear portions 34 and 36 respectively. The clamp means 40 is preferably located at the bottom region of each of the front and rear portion 34 and 36 respectively. The clamp means 40 comprises a turnable member 42 and a hinged strap member 44. The hinged strap member 44 has an opening 44A with predetermined dimensions, whereas the turnable member 42 has a head that is dimensioned so as to be inserted into the opening 44A. The turnable member 42 has provisions, known in the art, so that it may be turned and capture the hinged strap 44 as shown in FIG. 2. Conversely, the turnable member 42 is also turnable to be aligned within the opening 44A so that the front and rear portions 34 and 36, respectively, may be separated as shown in FIG. 3. As further seen in FIG. 3, the turnable member 42 and hinged strap member 44 have fasteners 46 which are screwed into shell 12 and respectively affix the hinged strap member 44 and the turnable member 42 to the rear and front portions 36 and 34 respectively.

As still further seen in FIG. 3, the rear portion 36 has outwardly extending lips 48 that fit under the receiving edges of the front portion 34.

In operation, and with reference to FIGS. 2 and 3, when a person is involved in an impact injury, the helmet 10 is in a configuration such as that shown in FIG. 2 and is snugly fitted about the head of the wearer. To remove the helmet 10 from the wearer (not shown), a person need only turn the turnable member 42 so that it is in alignment with the opening 44A allowing the hinged strap member 44 to be separated from the turnable member 42 which, in turn, allows for the front section 34 to be hingedly separated preferably about the vertical axis 14 (see FIG. 1), by means of hinge means 38, from the rear portion 36, thereby, allowing the easy removal of the helmet 10 from about the head of the wearer without causing any further disturbance to the head and/or neck regions of the wearer.

Another embodiment of the present invention may be further described with reference to FIG. 4 showing a second embodiment of a clamp means comprising a buckle arrangement 52 having a fastener member 54 with a catch member 56, and a lever member 58 having a mounting member 60, a hinge 62A hingedly connected to one end of an arm 62 which has a hook 64 at its other end. The buckle arrangement 52 is known in the art and is typically found on a ski boot or some other boot covering the foot or leg of a wearer. The fastener member 54 and the mounting member 60 are preferably respectively connected to the rear and front portions 36 and 34, respectively, by means of fasteners 46 in a manner similar to that described for the clamp means 40 of FIG. 3.

In operation, to place the helmet 10 into its closed condition similar to that shown in FIGS. 1 and 2, lever member 58 is used so that the arm 62 carrying the hook 64 is urged away from the front portion 34, while at the same time the rear portion 36 is moved toward the front portion 34 so that the hook 64 fits over and engages the catch member 56 and allowing the engagement to serve as a point for applying a downward force, via the arm 62, for bringing together and clamping together the front and rear separable portions 34 and 36, respectively, so that the configuration of the helmet 10 of FIG. 4 is transformed to that shown in FIGS. 1 and 2. Conversely, to disconnect the hook 64 from the catch member 56, the hinged arm 62 is gripped and urged outwardly from the front portion 34 so that the hook 64 moves away from and clears the catch 56 and, thereby, allowing the front portion 34 from being separated from the rear portion 36.

A still further embodiment of the present invention may be described with reference to FIG. 5 showing a third embodiment of a clamp means comprising a tongue and groove arrangement, wherein the groove comprises an opening or hole 70 between the walls or rear section 36. The tongue comprises a plug or protuberance 74 that is located on the inner surface of a strap 76 that extends outward from the edge of the front section 38 facing the corresponding receiving opening 70. The hole 70 and the plug 74 are dimensioned, relative to each other, so that the plug 74 may be pressed into the hole 70, preferably in a snap-lock detent manner, and is snugly engaged and captured therein. The strap 76 is dimensioned, relative to the plug 74, so that the strap 76 enters opening 70 when the confronting edges meet so that the plug 74 (tongue) springs into the hole 70 (groove). Pushing in the plug 74 releases the detent spring so that the strap 76 is separated from opening 75 by moving sections 36 and 38 apart.

Also a separate opening is connected to the rear and front portions 36 and 34 by means of fasteners of some type in a manner similar to that described for the clamp means of FIGS. 3 and 4. Furthermore, it is preferred that the tongue and groove arrangement of FIG. 5 with a separate opening 70 on rear section 36 be indented into the surface to form a flat surface and, thus, a flush mounted arrangement. If desired, the flush mounted arrangement may be provided for the clamp means of FIGS. 3 and 4.

In operation, to place the helmet 10 into its closed condition similar to that shown in FIGS. 1 and 2, the front and rear portions 34 and 36 are brought together and the plug 74 is pushed into the opening 75 so that the protuberance or plug 74 springs into opening 70 for snug engagement therebetween, while at the same time allowing the helmet 10 to be placed on the head of a wearer in a manner as previously described. Conversely, to remove the helmet from a wearer, especially after an accident, a person need only urge the plug 74 inward out of the hole 70 which, in turn, allows the front section 34 to be hingedly separated preferably about the vertical axis 14 (see FIG. 1), by means of hinge means 38, from the rear section 36, thereby, allowing the easy removal of the helmet 10 from about the head of a wearer without causing any further disturbance to the head and/or neck regions of the wearer.

It should now be appreciated that the practice of the present invention provides for different embodiments each of which yield a helmet 10 having front and rear portions 34 and 36 that are easily separated and, thereby, allowing for the easy removal of the helmet 10 from the head of the wearer without further agitating the head and/or neck regions of the wearer, thereby, preventing any further injury to the associated body components of the head and/or neck regions of the wearer.

Although the invention has been described with reference to certain preferred embodiments thereof, those skilled in the art will appreciate that various modifications, changes, omissions and substitutions may be made without departing from the spirit of the invention. It is intended, therefore, that the invention be limited only by the scope of the appended claims.

What we claim is:

1. A helmet comprising a material resistant to impact and providing covering for the head of a wearer, said helmet having a defined vertical axis and comprising:

(a) front and rear separable portions with the front portion having a face with an opening therein, each of said front and rear separable portions being contoured so a to generally conform to the head of the wearer;

(b) hinge means for hingedly bringing together said separable front and rear portions longitudinally along said vertical axis; and (c) clamp means for pressing and holding together said separable front and rear portions, wherein said clamp means comprises;

(i) a hinged strap having means for being connected to one of said front and rear separable portions and having an opening therein with predetermined dimensions; and (ii) a turnable member having means for being connected to the other of said front and rear separable portions and having a head dimensioned to be insertable into said opening and means so as to turn and capture said hinged strap.

2. The helmet according to claim 1, wherein each of said front and rear portions has upper, central and bottom regions and wherein said hinge means has means for mounting on the uppermost portion of said upper regions and said clamp means has means for mounting on said bottom regions.

3. The helmet according to claim 1, wherein said opening of said face of said front portion is covered with a transparent and impact resistant piece of plastic.

4. A helmet according to claim 1, wherein each of said front and rear separable portions being contoured so as to generally conform to the head of the wearer and having impact padding means on the interior surface so as to further conform said front and rear portions to said head of said wearer.

5. A helmet according to claim 1, wherein said front and rear portions having outwardly extending lips comprising mating facing edges for cooperatively assisting in the mating of said front and rear portions to and from their separable and closed assembled positions.

6. A helmet comprising a material resistant to impact and providing covering for the head of the wearer, said helmet having a defined vertical axis and comprising:

(a) front and rear separable portions with the front portion having a face with an opening therein, each of said front and rear separable portions being contoured so a to generally conform to the head of the wearer;

(b) hinge means for hingedly bringing together said separable front and rear portions longitudinally along said vertical axis; and (c) clamp means for pressing and holding together said separable front and rear portions, wherein said clamp means comprises a buckle arrangement comprising;

(i) a fastener member having a catch member having means for being connected to one of said front and rear separable portions; and (ii) a hinged lever member having mounting means for being connected to the other of said front and rear separable portions, said hinged lever member having a first and second ends, a hook at said first end for engaging said catch member and said engagement serving as a point for applying a force by means of said second end so as to bring together said front and rear separable portions.

* * * * *